United States Patent [19]

Tawfik et al.

[11] Patent Number: 5,042,960

[45] **Date of Patent: * Aug. 27, 1991**

[54] METHOD FOR SUPPORTING OFFSHORE WELL CAISSON

[75] Inventors: Adel S. Tawfik, Houston; Richard G. Urquhart, Dallas, both of Tex.

[73] Assignees: Atlantic Richfield Company, Los Angeles, Calif.; Brown & Root, Inc., Houston, Tex.

[ * ] Notice: The portion of the term of this patent subsequent to Mar. 14, 2006 has been disclaimed.

[21] Appl. No.: 491,914

[22] Filed: Mar. 12, 1990

[51] Int. Cl.[5] ..... E02B 17/00

[52] U.S. Cl. ..... 405/227; 405/204; 405/228

[58] Field of Search ..... 405/195, 203, 204, 224, 405/227, 228

[56] References Cited

U.S. PATENT DOCUMENTS

| | | | |
|---|---|---|---|
| 4,422,805 | 12/1983 | Sweatman | 405/227 X |
| 4,493,592 | 1/1985 | Knox | 405/227 X |
| 4,558,973 | 12/1985 | Blanford | 405/227 X |
| 4,576,523 | 3/1986 | Smetak | 405/227 |
| 4,679,964 | 7/1987 | Blanford | 405/227 X |
| 4,721,416 | 1/1988 | Gracia | 405/227 |
| 4,812,080 | 3/1989 | Urquhart | 405/227 |
| 4,842,446 | 6/1989 | Carruba | 405/227 |

*Primary Examiner*—David H. Corbin

*Attorney, Agent, or Firm*—Michael E. Martin

[57] ABSTRACT

Offshore well drivepipe or caisson may be supported by a skeletal frame type supported having spaced apart caisson receiving guide sleeves and spaced apart sets of pile guide sleeves interconnected by lateral and diagonal brace members. The support may be totally submerged and sleeved over the caisson while resting on the seabed and secured thereto by conventional piles which are installed through the pile guide sleeves and driven to temporary or permanent depth. The support structure provides a low-cost, reusable, temporary or permanent support for well caissons or drivepipes.

8 Claims, 1 Drawing Sheet

METHOD FOR SUPPORTING OFFSHORE WELL CAISSON

BACKGROUND OF THE INVENTION

1. Field of the Invention

The present invention pertains to an improved method of supporting a well caisson or drivepipe extension by the use of a submerged support frame which may be installed temporarily and/or permanently, provides for reducing the weight of the caisson and makes the caisson less vulnerable to buckling.

2. Background

In the development of offshore oil and gas wells, one conventional practice involves driving or otherwise installing an elongated caisson or casing member, sometimes also known as a drivepipe, which extends at least from the seafloor to a point above the sea surface so that drilling and various other well operations may be carried out through the caisson or drivepipe. A longstanding problem has been to provide adequate support for such a caisson. In many instances the caisson is required to be particularly heavy walled so that it may be free standing without other support. This, of course, increases the cost of the well and, in many instances, the caisson installation time.

Our U.S. Pat. No. 4,812,080 issued March 14, 1989 and assigned jointly to the assignees of this invention describes a unique support member or "jacket" for supporting an offshore platform wherein two or more piles are provided as the anchoring structure as well as a part of the jacket structure. An arrangement of diagonal and/or lateral braces together with tubular guide sleeves makes up at least one embodiment of the jacket wherein one or more vertical column members are then formed by a well casing and the aforementioned piles.

However, it has been determined that some features of the support member or jacket described in U.S. Pat. No. 4,812,080 may be adapted for use as a totally submerged temporary or permanent support system for a well caisson, drivepipe or similar free-standing well support member. Certain ones of the more important features of the present invention and other superior aspects are described hereinbelow.

SUMMARY OF THE INVENTION

The present invention provides an improved method of supporting a well caisson or drivepipe extending generally vertically upward from a seafloor with a unique support member which may be temporarily or permanently installed in a totally submerged arrangement.

Several advantages are provided by the method of the present invention. The support may be temporarily or permanently installed and either stabbed over existing well caissons or installed prior to installation of the well caisson and the subsequent drilling operations. The support is relatively lightweight, presents low resistance to wave and water current action and is easily installed and salvaged with minimal underwater work.

The support member and the method according to the present invention provide for minor underwater work to be carried out by divers, ease of installation of the support, ease of salvage and reuse with minimal modification. Those skilled in the art will recognize these and other advantages and superior features of the invention upon reading the detailed description which follows in conjunction with the drawing.

DESCRIPTION OF A PREFERRED EMBODIMENT

The subject matter of U.S. Pat. No. 4,812,080 is incorporated herein by reference.

Figure 1:
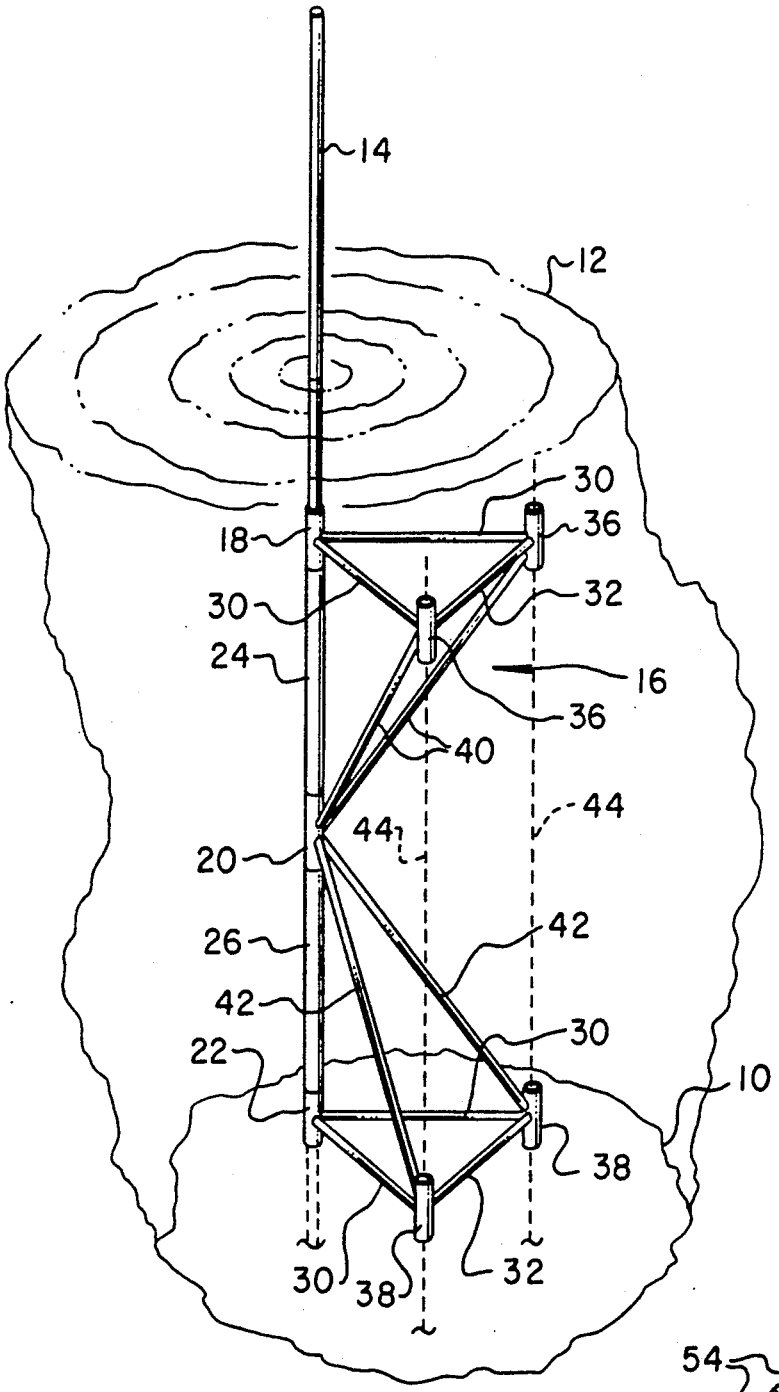
FIG. 1 is a perspective view of a support for a well caisson and the like in accordance with the method of the present invention.

Referring FIG. 1 there is illustrated a body of water 9 having a seabed or seafloor 10 and a water surface 12. An elongated well caisson or drivepipe 14 is shown installed through the body of water into the seabed 10 and supported by a preferred embodiment of an improved support member in accordance with the present invention and designated by the numeral 16. The support 16 includes spaced apart cylindrical sleeve members 18, 20 and 22 which may or may not have interposed therebetween and suitably secured thereto cylindrical sleeve portions 24 and 26. In one embodiment of the invention, the support 16 may include only the short sleeve members 18, 20 and 22 whereas in alternate embodiments of the support, the sleeve members 18, 20 and 22 together with the intermediate sleeve portions 24 and 26 may be formed as a single elongated, vertically disposed column sleeve member. The support 16 includes spaced-apart upper and lower arrangements of lateral brace members 30 and 32, the upper set of which are, as illustrated, interconnected to the sleeve 18 and to nodal sleeve members 36. In like manner the lower set of lateral braces 30 and 32 are connected to the sleeve members 22 and 38, as illustrated. The sleeve members 36 are also interconnected with the sleeve member 20 by diagonal brace members 40 while the sleeve members 38 are interconnected with the sleeve member 20 by diagonal braces 42.

FIG. 1 also illustrates in somewhat schematic form the presence of generally vertically extending piles 44 which are shown in place extending through the spaced apart sets of sleeve members 36 and 38, respectively. The piles 44 may be connected to the support 16 in the same manner as described in U.S. Pat. No. 4,812,080 and as illustrated in FIG. 6 of the patent drawing. This type of connection may be temporary or permanent.

Figure 2:
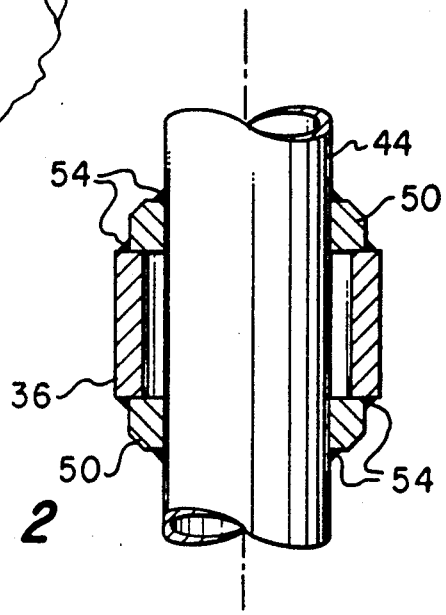
FIG. 2 is a detail view of one embodiment of a temporary connection between the support member and a pile.

An alternate embodiment of a temporary connection between one of the piles 44 and one of the upper sleeve members 36 is illustrated in FIG. 2. During the temporary installation phase, once the piles have been driven to their predetermined position, one or more support rings 50 may be sleeved over a pile and temporarily welded to the pile and to the sleeve 36 as indicated by the numeral 54. In the case of the lower support ring 50, this ring may either be split or be preinstalled temporarily connected to the sleeve 36 before the pile is installed through the sleeve 36. When it is desired to start redriving the pile 44 during the second stage of installing the support 16, a diver would cut the welds 54 or the welds may be predetermined to be of sufficient strength that they may be broken through the redriving effort itself.

By providing the support 16 with the caisson or drivepipe guide sleeves 18, 20 and 22 which are vertically spaced apart or are formed as one continuous sleeve, as aforedescribed, the caisson 14 is less vulnerable to buckling during well drilling and installation operations or upon completion of the well. Moreover, it is possible to provide lighter weight caisson pipe since the support provided by the support member 16 obviates the requirement for a stiffer caisson member.

One preferred method of providing added support for a well caisson in accordance with the present invention is carried out as follows. The support 16 is preinstalled on the seabed 10 in proximity to the point at which the well caisson 14 is to be installed. The piles 44 are lowered through the pairs of sleeves 36 and 38 and driven into the seabed sufficiently to fix the support 16 in place. Temporary pile-to-support connections are installed at the sleeves 36 by divers using the type of connection shown in FIG. 6 of U.S. Pat. No. 4,812,080 or the type of connection shown in FIG. 2 hereof. The caisson 14 is then lowered through the sleeves 18, 20 and 22 and driven to its prescribed depth. Well drilling operations may then be carried out and, if the well is successful, the pile-to-support connections at the sleeves 36 are severed and the piles 44 may then be redriven to a permanent, more secure depth. Added length of piling is provided to the piles 44 as required to prevent the piles from being driven downwardly out of the upper set of guide sleeves 36. Upon full driving of the piles 44 to their prescribed depth, the form of connections abovedescribed and illustrated in U.S. Pat. No. 4,812,080 may be reinstalled to secure the piles 44 to the sleeves 36. This is virtually the only under-water diver required work to be done on the support 16 after it is installed on the seabed 10. Thanks to the support 16 and the triangular arrangement of column members provided by the caisson 14 and the piles 44, a substantially rigid support structure is provided for supporting the caisson 14 both temporarily and permanently.

Alternatively, in the instance where the caisson 14 is already installed, the support 16 may be "stabbed" or sleeved over the caisson 14 by suitable handling equipment above the water surface 12, lowered to the seabed 10 and followed by driving of the piles 44 to their temporary or permanent installation depth.

The abovedescribed method and construction of the support 16 may be carried out using conventional engineering practices apart from the novel steps comprising the present invention. The support 16 may be constructed of conventional engineering materials used for offshore marine structures. For example, a support 16 having an overall height of about 100 feet may be constructed using tubulars for the upper support members 30 and 32 of a nominal 20.0 inch diameter while the lower tubulars making up the members 30 and 32 may be slightly smaller in diameter. For accepting a 24.0 inch diameter caisson, the sleeves 18, 20 and 22 may be 35.0 inch or 36.0 inch diameter tubulars having 1.0 inch to 1.50 inch wall thickness. The guide sleeves 36 and 38 may also have the same proportionate sizes in relation to the piles 44. Connections between the respective guide sleeves and the lateral braces 30, 32, 40 and 42 may be by conventional welding practice. The diameters of the tubular brace members 40 and 42 may be in the range of 18.0 inches to 24.0 inches with nominal wall thicknesses of 0.375 inches to 0.50 inches, respectively.

Although a preferred embodiment of the present invention has been described in detail herein, those skilled in the art will recognize that various substitutions and modifications may be made without departing from the scope and spirit of the invention as recited in the appended claims.

What is claimed is:

1. A method for supporting an offshore well caisson or drivepipe extending generally vertically from a seabed to a point thereabove comprising the steps of:

providing a support member comprising generally vertically oriented tubular sleeve means adapted to be sleeved around said caisson in supporting relationship thereto, said sleeve means being a continuous vertically-extending sleeve or a plurality of vertically spaced-apart sleeves aligned one with the other, lateral brace means extending from said sleeve means to plural spaced-apart pile guide sleeves, and diagonally-extending brace means extending generally upwardly and downwardly, respectively, between an intermediate point on said sleeve means and said spaced-apart pile guide sleeves to form a unitary support for said caisson and for receiving generally vertically-extending anchor piles for anchoring said support member to the seabed;

positioning said support member on the seabed in a predetermined location;

driving respective piles through respective sets of vertically spaced-apart pile guide sleeves to a predetermined depth; and inserting said caisson through said sleeve means and conducting well operations through said caisson.

2. The method set forth in claim 1 including the step of:

redriving said piles to a further predetermined depth.

3. The method set forth in claim 1 including the step of:

securing said piles to said pile guide sleeves.

4. The method set forth in claim 2 including the step of:

providing connector means for connecting said piles to said pile guide sleeves and connecting said piles to said pile guide sleeves after at least one of said pile driving efforts.

5. A method for supporting an offshore well caisson or drivepipe extending generally vertically from a seabed to a point thereabove comprising the steps of:

providing a support member comprising generally vertically oriented tubular sleeve means adapted to be sleeved over said caisson in supporting relationship thereto, said sleeve means being a continuous vertically-extending sleeve or a plurality of vertically spaced-apart sleeves aligned one with the other, lateral brace means extending from said sleeve means to plural spaced-apart pile guide sleeves, and diagonally-extending brace means extending generally upwardly and downwardly, respectively, between an intermediate point on said sleeve means and said spaced-apart pile guide sleeves to form a unitary support for said caisson and for receiving generally vertically-extending anchor piles for anchoring said support member to the seabed;

stabbing said support member over said caisson with said caisson extending through said sleeve means and positioning said support member on the seabed in a predetermined location; and driving respective piles through respective sets of vertically spaced-apart pile guide sleeves to a predetermined depth.

6. The method set forth in claim 5 including the steps of:

conducting well operations through said caisson and redriving said piles to a second predetermined depth.

7. The method set forth in claim 5 including the step of:

providing connector means for connecting said piles to said pile guide sleeves and connecting said piles to said pile guide sleeves after at least one of said pile driving efforts.

8. The method set forth in claim 7 including the step of:

securing said piles to said pile guide sleeves.

* * * * *